United States Patent [19]

Didek et al.

[11] Patent Number: 4,553,383

[45] Date of Patent: Nov. 19, 1985

[54] METHOD OF AND APPARATUS FOR SPINNING YARN FROM STAPLE FIBERS IN AN AIR VORTEX .

[75] Inventors: Stanislav Didek; Ludvik Fajt; Marketa Reymanova; Marie Markova, all of Usti n.Orl., Czechoslovakia

[73] Assignee: Vyzkumny ustav bavlnarsky, Usti n.Orl., Czechoslovakia

[21] Appl. No.: 561,546

[22] Filed: Dec. 14, 1983

[30] Foreign Application Priority Data

Dec. 21, 1982 [CS] Czechoslovakia ..... 9463-82

[51] Int. Cl.[4] ..... D01H 1/13; D01H 7/898

[52] U.S. Cl. ..... 57/403

[58] Field of Search ..... 57/403, 400, 333, 350

[56] References Cited

U.S. PATENT DOCUMENTS

| | | | |
|---|---|---|---|
| 3,577,720 | 5/1971 | Zax et al. | 57/403 |
| 3,994,120 | 11/1976 | Random et al. | 57/403 |
| 4,077,197 | 3/1978 | Bowden et al. | 57/403 |
| 4,174,605 | 11/1979 | Pallay | 57/403 |

*Primary Examiner*—Donald Watkins

[57] ABSTRACT

Method of and apparatus for spinning yarns from staple fibers in an air vortex in a stationary spinning tube axially coupled by one of its ends to a stationary air chamber, and by its other end to a sub-atmospheric pressure source. A flow of discrete fibers is supplied into the air chamber onto the wall of an air vortex which entrains, doubles and densifies the fibers before they are taken onto an open end of yarn which is given an additional twist while being withdrawn in the region between the air chamber and a take-off device. A fiber supply duct which opens into the air chamber is oriented toward the wall of the air vortex, an additional twisting device being provided between said twisting device and said air chamber.

9 Claims, 8 Drawing Figures

METHOD OF AND APPARATUS FOR SPINNING YARN FROM STAPLE FIBERS IN AN AIR VORTEX

The invention relates to a method of spinning yarn from staple fibers in an air vortex in a stationary spinning tube axially coupled to a stationary air chamber, by taking supplied individualized fibers onto an open yarn end engaging into the spinning tube which communicates with a sub-atmospheric pressure source, and from which the arising yarn is withdrawn by a take-off device in a direction counter to the axial motion of an air vortex produced in the air chamber and directed toward its axis.

Another object of the invention is to provide an apparatus for carrying out the method, comprising a stationary air chamber with means for producing air vortex in said chamber, a yarn take-off duct axially engaging into the air chamber, a stationary spinning tube communicating by one of its ends with a subatmospheric pressure source, and by its other end with said air chamber, a supply duct for introducing individualized fibers into the spinning process, and a take-off device for withdrawing the yarn through said take-off duct from the spinning tube.

Advantages of the open end yarn spinning systems based upon the air vortex principle consist in a simplicity of spinning means which are free of any rotary elements, further in space economy, and in a high output of the spinning unit at a relatively low power consumption.

A typical spinning system of this kind has been disclosed in the British patent specification No. 1,209,882. The spinning mechanism is embodied as an air chamber which is followed by a cylindrical spinning tube into which a fiber supply duct from the separating device opens. The end of the spinning tube communicates with a sub-atmospheric pressure source whereby a vacuum in the spinning tube interior prevails.

The air chamber which comprises an annular cavity narrowing toward the inlet of a yarn take-off tube which axially passes through said air chamber, is housed in a distributing chamber communicating with a superatmospheric pressure source as well as with the air chamber through tangentially oriented channels.

The open end of yarn withdrawn from the spinning device through the take-off tube, engages into the spinning tube. The mouth of the air chamber is followed by a cylindrical neck which flares into the spinning tube.

In the air chamber there is produced, by tangentially supplying pressurized air, an intensively rotating air vortex entering, due to the vacuum effect, the spinning tube in which individual fibers supplied through the supply duct are taken onto the open end of yarn helically revolving on walls of the spinning tube. The rotating air vortex escapes from the air chamber along a spiral course converging to the axis of the take-off tube but, due to an effect of the cylindrical neck, it expands again, rotates and advances through the entire profile of the spinning tube into which the yarn open end engages, fibers being supplied in the spinning tube onto the rotating air vortex.

According to another known method of open-end spinning yarns in air vortex (East German patent specification No. 46,985), individualized fibers are supplied into a spatially confined air vortex produced in a spinning tube, and are taken onto the open end of twisted yarn which is withdrawn in counterdirection of the axial air vortex motion component.

An apparatus for carrying out this process comprises an air chamber merging into a spinning tube which is twice neck-like tapered toward its end. Immediately downstream of the second taper in the form of de Laval nozzle, the fiber supply duct from the separating device enters the spinning tube. At the opposite side, the air chamber is followed by the yarn take-off tube, the yarn open end engaging into the spinning tube.

The rotating air vortex produced in the air chamber advances through the spinning tube, sets the yarn open end in rotation and, owing to its both rotary and axial motion, carries along individual fibers sucked by an ejection effect from the separating device through the supply duct into the spinning tubes, the fibers being taken onto the yarn open end.

In the axis of the spinning device, between the yarn take-off device and the take-off duct of the spinning device, there is provided at least one separate pneumatic twisting chamber for finally twisting the yarn withdrawn from the spinning tube.

A common substantial disadvantage of the two above-described solutions of air vortex yarn spinning systems as well as a plurality of other systems of prior art consists in that in the spinning process, fibers are not cyclically doubled as is usual in the open end rotor spinning process but that a densified fiber flow is immediately taken onto the yarn open end whereby the structure and evenness of the final yarn product are negatively influenced.

Apart from this, the air vortex spinning principle does not provide conditions for the axial tensioning of fibers in the yarn open end, which is indispensable for the desired fiber migration. Due to the fact that fibers are supplied immediately onto the rotating yarn open end, the rotation is simultaneously braked and the productivity of such systems drops.

Even though with some of the progressive solutions in the art of air vortex spinning machines, relatively high output and effectiveness have been reached, the fact that the fibers in the spinning process are not cyclically doubled and axially tensioned, is responsible for the character of the final yarn product.

It is an object of the present invention to provide a method of open-end spinning yarns in an air vortex, wherein the fibers supplied to the rotating yarn open end are cyclically doubled and axially tensioned. These processes are desirable for spinning very even, first-grade yarns.

Another object of the invention is to provide a simple and highly effective apparatus for carrying out this method.

The above conditions are substantially met by a method of spinning yarn from staple fibers in an air vortex in a stationary spinning tube axially coupled to a stationary air chamber, by taking supplied individualized fibers onto an open yarn end engaging into the spinning tube which communicates with a sub-atmospheric pressure source, and from which the arising yarn is withdrawn by a take-off device in counterdirection to the axial motion of an air vortex produced in the air chamber and directed toward its axis.

According to the invention, in the air chamber there is produced a funnel-shaped air vortex which is sucked off by the spinning tube and has an internal and an external air wall, and wherein individualized fibers are supplied in the air chamber onto one of said air walls of the air vortex which entrains, doubles and takes the fibers in the spinning tube onto the open end of yarn additionally twisted during the take-off in the region between the air chamber and the take-off device.

A layer of doubled fibers produced on the wall of the air vortex in the air chamber is continuously sucked into the spinning tube, due to a vacuum effect therein. The withdrawn yarn is wound in a known way in a spooling device to a cross-wound package. The flow of individualized fibers is supplied in the air chamber onto the inner, or outer wall, or directly into the air vortex.

The apparatus for carrying out the method comprises a stationary air chamber, means for producing in said chamber an air vortex converging to the chamber axis, a yarn take-off duct axially engaging into the air chamber, a stationary spinning tube communicating by one of is ends with a sub-atmospheric pressure source, and its other end with said air chamber, a supply duct for introducing individualized fibers, and a take-off device for withdrawing the yarn through said take-off duct from the spinning tube, means for producing a funnel-shaped air vortex having an internal and an external air wall and sucked off by the spinning tube, the supply duct which opens into the air chamber, being directed so as to supply the individualized fibers in the air chamber onto one of said air walls, and wherein an additional twisting device is provided between the take-off device and the air chamber.

According to the invention, means are provided for producing a funnel-shaped air vortex having and internal and an external air wall and sucked off by the spinning tube, the supply duct which opens into the air chamber, being directed so as to supply the individualized fibers in the air chamber into the air vortex, and wherein an additional twisting device is provided between the take-off device and the air chamber.

The supply duct is directed so as to supply the individualized fibers onto the inner wall, or the outer wall, or into the wall of the air vortex in the air chamber.

The supply of fibers onto the vortex wall is the process wherein the fibers in the region of their incidence are oriented obliquely to said wall whereas the fiber supply into the air vortex is the process wherein the supply direction in the deposition region corresponds to a tangential plane relative to the vortex wall in the region of the fiber incidence.

The first preferred embodiment of the invention consists in that the air chamber is defined by a front wall which is perpendicular to the axis of the air chamber and which comprises a yarn take-off tube oriented in the axis of the air chamber, and by a funnel-shaped rear wall which tapers toward the spinning tube oriented in the axis of the air chamber into which the front part of supply duct extends obliquely to said axis.

The front wall of the air chamber in such first embodiment is the wall which is provided with the yarn take-off opening constituted, as a rule, by the edge of the take-off tube. The rear wall of the air chamber is the wall in which the inlet opening of the spinning tube is provided. The supply duct can enter the vortex wall either through the front wall or the rear one of the air chamber, or, alternatively, through a peripheral wall connecting said two walls with each other.

According to a second embodiment of the invention, the air chamber is defined by the funnel-shaped front wall which comprises the take-off tube oriented in the axis of the air chamber, and by the conical rear wall the narrower portion of which merges over an edge into the spinning tube oriented in the axis of the air chamber while its wider portion merges into said front wall over a trough, said trough being passed through by the front part of the supply duct.

In the rear wall of the air chamber in the second embodiment, there is provided at least one air nozzle formed by a radial guide gap in an inner annular cavity provided in the rear wall of the air chamber and communicating through holes oriented obliquely to the axis of the air chamber, with an outer annular cavity to which a pressurized pipeline is tangentially coupled.

According to a third preferred embodiment of the invention, the air chamber is defined, on the one hand, by the funnel-shaped front wall comprising the take-off tube oriented in the axis of the air chamber, there being provided in said front wall air nozzles in the form of holes communicating with ambient atmosphere and oriented obliquely to the axis of the air chamber and to the periphery of said wall, and, on the other hand, by the conical rear wall which is parallel to said front wall and merges over the edge into the spinning tube oriented in the axis of the air chamber, there extending into the space between said two walls, the front part of the supply duct which is defined by a spiral-shaped wall of a recess in the housing of the fiber separating device, and by the surface of a fiber opening cylinder mounted for rotation about the spinning tube.

According to a fourth embodiment the air chamber is defined by the planar front wall which is perpendicular to the axis of said air chamber, and by the planar rear wall which is parallel to said front wall, there being arranged between said walls a side wall in which air nozzles are provided, said nozzles having the form of ducts extending obliquely to said rear wall and tangentially to said side wall.

This new yarn manufacturing process based upon the open-end spinning principle ensures, on the one hand, a desirable fiber doubling, due to the rotation of the air vortex wall, and, on the other hand, the tensioning of fibers densified and taken onto the rotating yarn open end, said tensioning being provided by the air flow sucked in by the spinning tube outlet.

The structure of the thus manufactured yarn is characterized by high quality parameters.

Due to a high production caused by a very high technically obtainable rotation rate of the air vortex and consequently of the yarn open end, the spinning device is capable of producing a very uniform and strong yarn from cyclically doubled fibers.

With the usual exchangeability of the fiber opening cylinder in view, the apparatus according to the present invention permits various fibrous materials, both natural and synthetic, including very contaminated ones, to be processed.

The essential feature which distinguishes the invention from the prior art consists in the production of air vortex in the air chamber, said vortex, through the center of which the yarn open air passes, being sucked into the spinning tube. The fibers supplied in the air chamber onto one of the walls of the air vortex or, alternatively, into the air vortex, are doubled on the respective wall, or in the air vortex, densified and axially tensioned while they are taken onto the yarn open end. The air vortex wall substantially assumes the function of the slide wall and the collecting groove of a rotor open end spinning unit.

Some preferred embodiments of apparatus according to the present invention will be hereinafter described with reference to the accompanying drawings, in which.

Figures 1, 2:
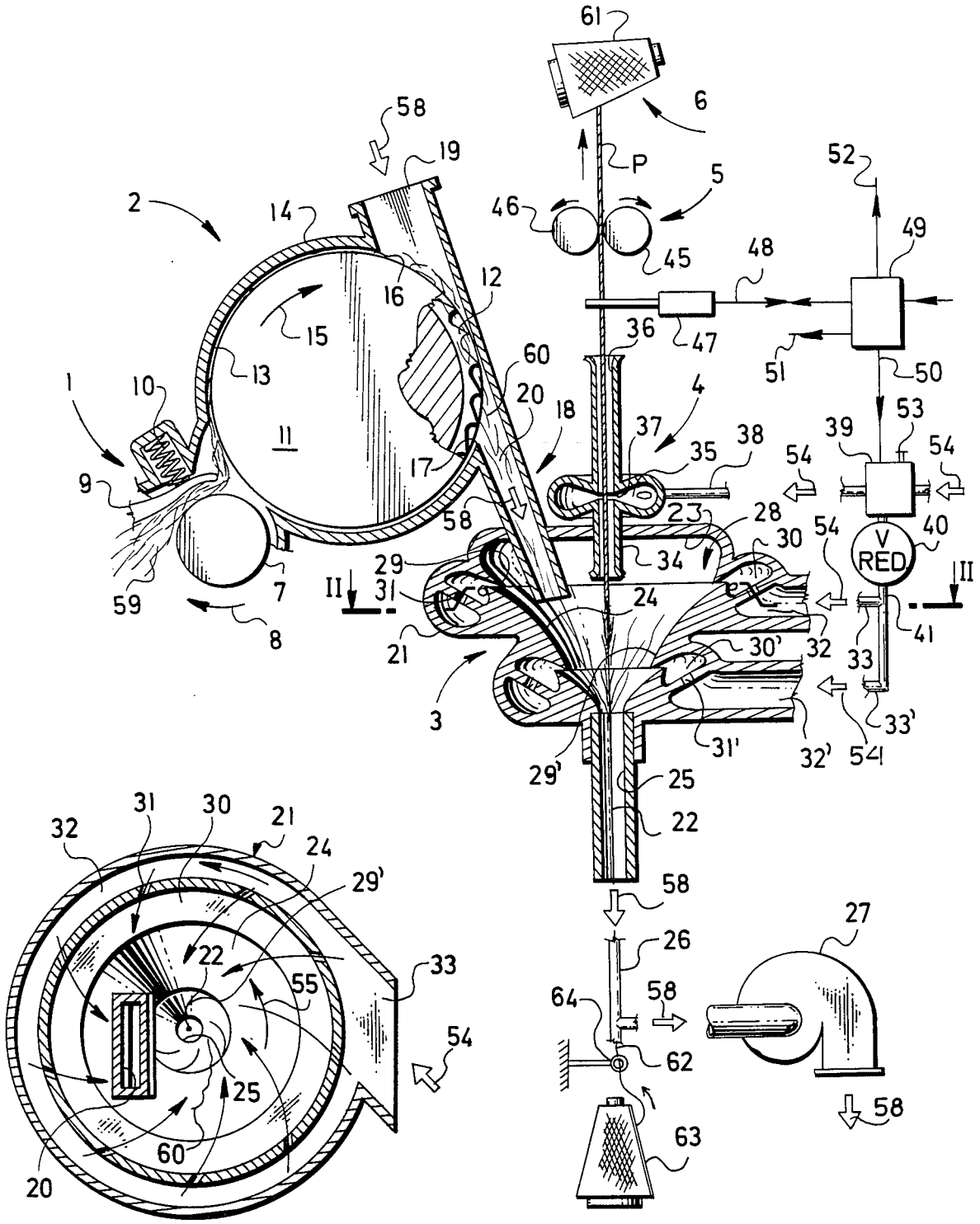
FIG. 1 is an axial sectonal view through the air chamber of a first embodiment of the apparatus of the invention.
FIG. 2 is a sectional view taken along the line II—II in FIG. 1.

FIG. 1 shows an open-end spinning unit which comprises, in the direction of material flow, a sliver feeding device 1, a fiber separating device 2, a spinning device 3, an additional twisting device 4, a yarn take-off device 5, and a spooling device 6.

The sliver feeding device 1 consists of a feed roller 7 mounted for rotation in the direction of arrow 8, and a shoe 9 which is forced by a spring 10 to said feed roller 7. The feed roller 7 is followed by a fiber opening cylinder 11 of the fiber separating device 2, said cylinder being provided on the surface by carding means 12. The two devices 1 and 2 are accomodated in a recess 13 provided in a housing 14. In the region of the fiber opening cylinder 11 which is mounted for rotation in the direction of arrow 15, the recess 13 merges by its rear edge 26 or upstream part 19 of said duct 18 communicates with the ambient atmosphere while its front or downstream part 20 enters a stationary air chamber 21 in an oblique direction relative to the axis 22 of said chamber 21. The air chamber 21 is defined by a front wall 23 which is perpendicular to its axis 22 and through which the front part 20 of the supply duct 18 enters the air chamber 21, and by a rear wall 24 in the form of a funnel which tapers toward a spinning tube 25 communicating by its outlet, through a pipeline 26 (schematically shown), with an external sub-atmospheric pressure source 27 such as a fan. The spinning tube 25 is fixed in an axial hole provided in the body of the air chamber 21.

The air chamber 21 is provided with means for producing an air vortex in its interior, said means being embodied, by way of example, by an air nozzle 29 (see also FIGS. 2, 3, 4) which is made in the rear wall 24 and has a form of a radial gap provided in an inner annular cavity 30. The cavity 30 which is provided in said rear wall 24 of the air chamber 21, communicates, through holes 31 oriented obliquely to the axis 22 of said chamber 21, with an outer annular cavity 32 into which a pressurized pipeline 33 tangentially opens.

In the exemplary embodiment shown in FIG. 1, another air nozzle 29' is coaxially provided in the rear wall 24 of the air chamber 21. The arrangement of this nozzle 29' corresponds to that of the air nozzle 29 so that the respective reference numerals are provided with a prime.

The front part 20 of the supply duct 18 is preferably directed tangentially to the rear wall 24 of the air chamber 21. In the axis 22 of said chamber 21 there is arranged a yarn take-off tube 34 which enters the chamber interior through the front wall 23 and simultaneously constitutes a supply tube for the additional twisting chamber 35 from which it is axially followed by an extension 36 of said take-off tube 34. The inlet and outlet ends of said take-off tube 34 and its extension 36, respectively, are flared. The take-off tube 34 and its extension 36, which latter has a larger diameter than the former, are separated from each other by a functional spacing 37.

A tubing 38 tangentially enters the twisting chamber 35, and is connected to the latter through an electromagnetic valve 39, with a super-atmospheric pressure source (not shown). From said electromagnetic valve 39 there extends, via a reducing valve 40, a branch pipe 41 connected to the pressurized pipelines 33, 33'. Due to the tangential supply of pressure air into the twisting chamber 35 there is produced in its interior, in a known way which need not be described here, a potential air vortex which imparts to yarn P, during its passage through the take-off tube 34 and its extension 36, a twist, a major part of said active air escaping through said extension into the ambient atmosphere while a minor portion thereof enters the interior of the air chamber 21 through said tube 34.

However, the additional twisting device 4, may be constituted by any other means suitable for the purpose.

Figure 3:
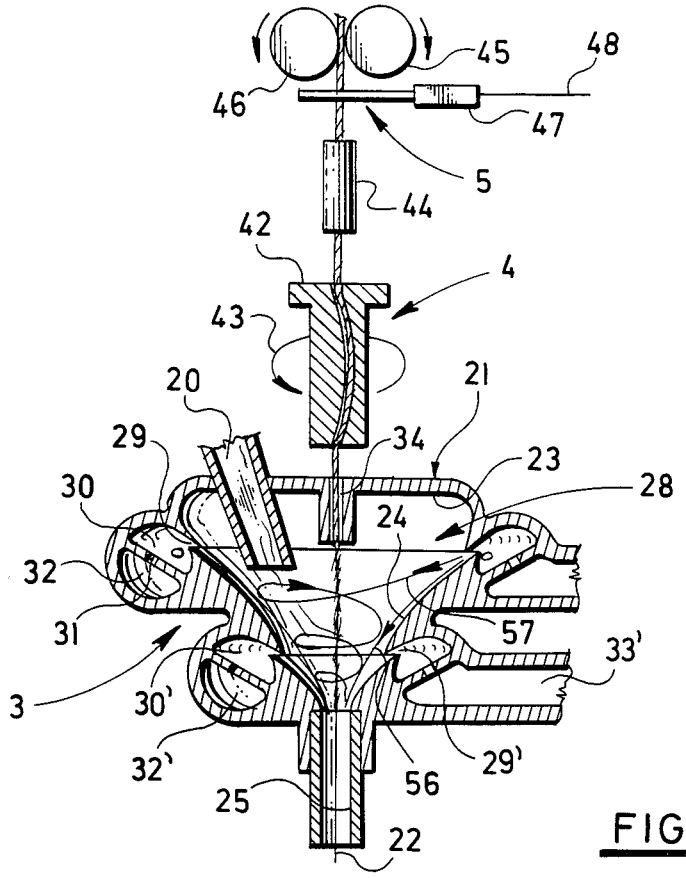
FIG. 3 shows a part of the spinning unit with the air chamber and a variant of the additional twisting device, in an axial sectional view through the air chamber.

As can be seen in FIG. 3, the twisting device is embodied, for instance, by a false twist tube 42 driven by not shown means in the direction of arrow 43. The false twist tube 42 is arranged in a housing (not shown) disposed between the take-off tube 34 and a stationary guiding duct 44 preceding the take-off device 5.

The feed roller 7, the fiber opening cylinder 11, the false twist tube 42 and the take-off rollers 45, 46 constituting the take-off device 5 are driven through not shown transmission means from the electromotoric drive of the open-end spinning unit (not shown).

Between the yarn take-off device 5 and the extension 36 of said take-off tube 34 (FIG. 1), or the guiding duct 44 (FIGS. 3 and 6), there is arranged a known detector 47 for controlling the tension of yarn P, which detector is connected via line 48 with a control unit 49 connected via line 50 with the electromagnetic valve 39, via line 51 with a not shown electromagnetic coupling interposed into the drive of the feed roller 7, and, alternatively, with the coupling in the drive of the false twist tube 42 (FIG. 3). The electromagnetic valve is provided with a pushbutton 53 for manual control (FIG. 1).

Pressure air (see arrows 54) supplied through the pressurized pipeline 33 into the outer annular cavity 32, is given a rotation and tangentially enters, while accelerated, and inner annular cavity 30 through holes 31. The walls of the gaps in the air nozzle 29 are oriented in such a direction as to cause the pressure air, on its escape out of the inner annular cavity 30, to take an intensive revolving motion about the axis 22 (see FIG. 2, arrow 55) as well as a translatory motion oblique to said axis 22 (see FIG. 3, arrow 56). The resultant of these both motions are spherical trajectories which are indicated in FIG. 3 by arrow 57 and which produce, in interaction with the shape of the rear wall 24 of the air chamber 21, a funnel-shaped air vortex which is sucked into the spinning tube 25 the outlet of which is connected to the sub-atmospheric pressure source 27. Owing to the ejection of air vortex and to the vacuum effect in the spinning tube 25, a sub-atmospheric pressure is produced in the supply duct 18. By this subatmospheric pressure, individualized fibers in the flow form are transported from the rotating opening cylinder 11 into the interior of the air chamber 21. The sub-atmospheric pressure directions are shown in FIG. 1 by arrows 58.

The orientation of gap walls of the air nozzle 29' corresponds to that of the air nozzle 29, the two air flows participating in the formation of the resulting air vortex.

The spinning unit described above operates as follows:

A sliver 59 of staple fibers withdrawn from a sliver can (not shown) is supplied by the feeding device 1 to the fiber opening cylinder 11 the carding means 12 of which comb out of the sliver individual fibers 60 which are accelerated in the gap between the opening cylinder 11 and the wall of the recess 13 of the housing 14. The fibers fly over the rear edge 16 into the interior of the supply duct 18 through which they are carried along with the air flow (see arrow 58) over the front edge 17 toward the outlet or front part 20 of said duct 18. After having left the duct mouth, the fibers fly obliquely to the axis 22, preferably tangentially to the rear wall 24 of the air chamber 21, and are deposited onto the inner wall of an air vortex sucked into the spinning tube 25. In this way, fibers are led up to the close proximity of said axis 22 which simultaneously constitutes the axis of rotation of the open end of yarn P being formed in the spinning tube 25. From fibers following the spherical trajectories (see FIG. 3, arrow 57) there is formed by doubling an elementary layer which, after entering the spinning tube 25, is densified and adheres to said yarn open end which is set in rotation by the inertia of the rotating fibrous layer mass flying thereonto, and particularly, however, by a rotation component of said air vortex, and by the downward propagation of twists in the yarn coming from the twist chamber 35.

The fibers, when being taken onto the yarn in the region between its open end and the twist chamber 35, are given a desirable axial tension by the action of the axial component of the air vortex, which tension is assisted by the suction effect produced in the spinning tube 25. Such a yarn open end which is being continuously built by taking on fibers delivered on the resulting spherical trajectories from the entire surface of the air vortex wall, is subsequently twisted in the twist chamber 35, the twist direction corresponding to the direction of rotation of yarn open end in the spinning tube 25. The thus produced yarn P which is axially withdrawn by take-off device 5, is finally wound in the spooling device on a bobbin 61. The fibers supplied to the quickly rotating wall of the air vortex are desirably cyclically doubled on said wall and are simultaneously and continuously densified in the direction of axis 22 while they contact the yarn open end. Due to the inertia of fiber motion, to the rotation component of the air vortex, and, particularly, due to the vacuum effect of the spinning tube 25, the yarn open end is held in the axis 22 of the air chamber 25, and, consequently, in the axis of the air vortex being produced. The open yarn end is rotated in the direction corresponding to that of twist imparted to the yarn by the twist chamber 35 whereby the formation of an unwanted false twist in the yarn in the region between the twist chamber 35 and the yarn open end is prevented.

The angular inclination of walls of the gap of the air nozzle 29 with respect to the axis 22 of the air chamber 21 determines the air flow power action on the fibers being doubled, and, in interaction with the vacuum effect of the spinning tube 25, also on the yarn open end in which the individual fibers are tensioned by said action, whereby an intensive entanglement of fibers to yarn form is ensured. The intensity of said power action can be increased, with a given nozzle inclination, by raising the air pressure, or by installing a plurality of such nozzles as, for example, two air nozzles 29, 29' one after the other as well as by modifying the vacuum effect of the spinning tube 25. The power action on the fibers following spherical trajectories coverging to the axis 22, enables the rotating yarn open end to recapture practically all the fibers.

The spinning-in process, for example, in case of a thread breakage, takes place as follows:

In the normal spinning process, the operational tension of yarn P is detected by a tension detector 47 which monitors the drive of the sliver feeding device 1, the yarn take-off device 5, the electromagnetic valve 39 for supplying pressure air into the pipeline or tubings 33, 33', 38 in order to produce the potential air vortex in the twist chamber 35 and the funnel-shaped air vortex in the air chamber 21.

In case of a thread breakage, the detector 27 will stop, through the control unit 49, the feed of sliver 59 to the feeding device 1, the operation of the take-off device 5, and the feed of pressure air into the twist chamber 35 and the air chamber 21. Broken yarn and fiber remnants are recaptured by a not shown filter of the sub-atmospheric pressure source 27. After stopping the above-mentioned steps, the sub-atmospheric pressure source further operates so that in the spinning tube 25, the air chamber 21 and in the take-off tube 34 as well as its extension 36, an operational sub-atmospheric pressure is produced by sucking in air from the ambient atmosphere.

To perform the spinning-in process, the operator introduces a suitable length of yarn unwound from the bobbin 61 in the spooling device 6 into the flared outlet of the take-off tube extension 36 from which the yarn is sucked, due to the operational sub-atmospheric pressure, into the spinning tube 25. Owing to the action of air vortex in the spinning tube 25, the tension in this yarn length rises up to a limit value to switch on the detector 47. By its signal transmitted through control unit 49, the air feed through the pipelines 33, 33' into the air chamber 21 as well as through the tubing 38 into the twist chamber 35 and further the fiber feed into the feeding device 1 are re-established while, after a delay, the take-off device 5 is switched on so as to withdraw yarn P being built in the spinning tube 25.

The above-described spinning unit also permits core yarns to be manufactured. To this purpose, the spinning tube 25 is supplied, in the yarn take-off direction, with a core component 62 which is unwound from a supply package 63 through a thread guide 64. The yarn component 62, when passing through the spinning tube 25 and the air chamber 21, is wrapped, in one of the known and therefore not specified ways, with yarn P being built in the spinning tube 25.

Figure 4:
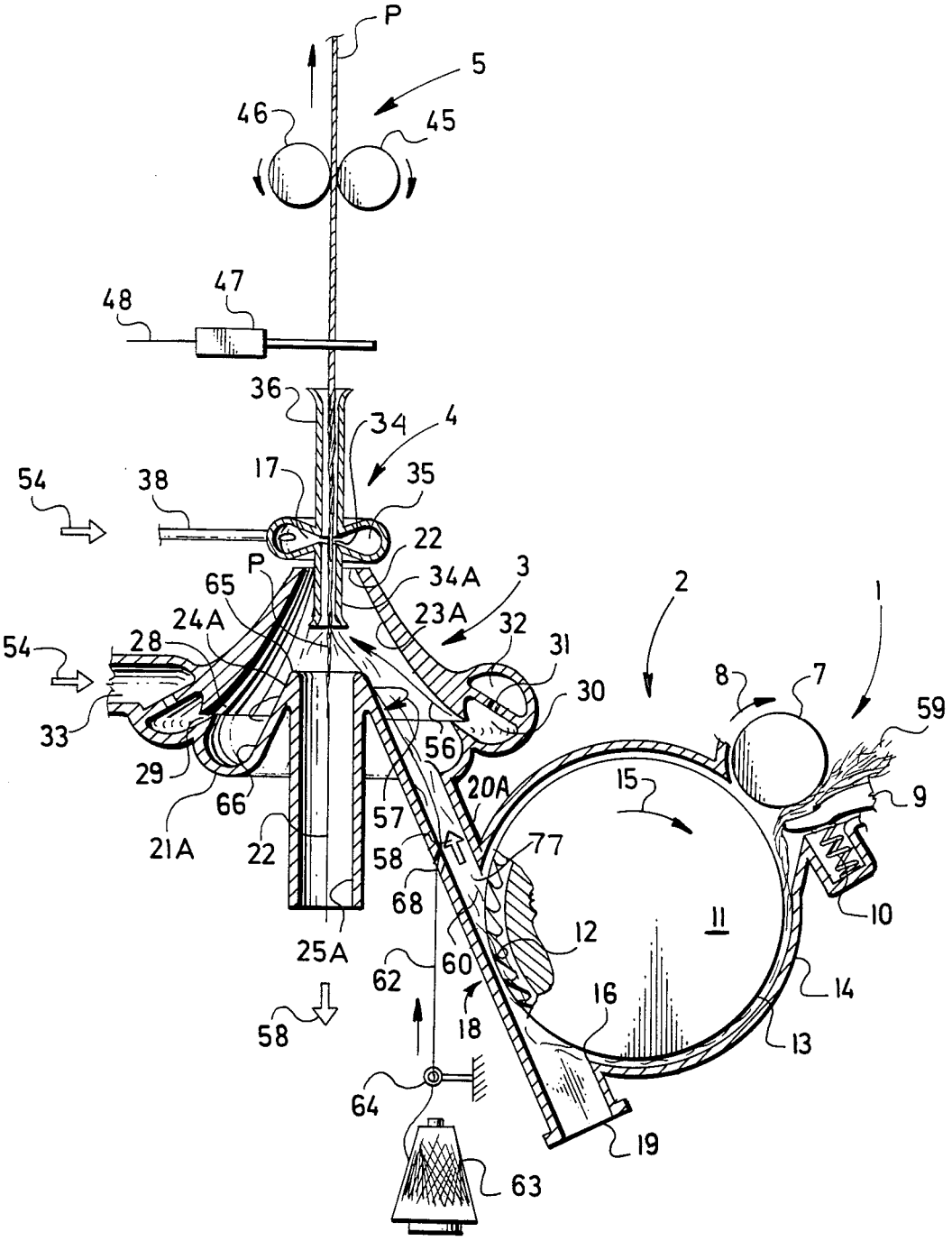
FIG. 4 shows the spinning unit with a variant of the air chamber, in an axial sectional view through the air chamber.

FIG. 4 shows an alternative embodiment of the spinning device 3. In this embodiment, the air chamber 21A is defined by the funnel-shaped front wall 23A, the narrower end portion of which is passed through by the take-off tube 34A extending in the axis 22 of the air chamber 21A, and by the conical rear wall 24A which merges on its narrower end portion, over an edge 65, into the spinning tube 25A, while, on its wider end portion, through a trough 66, into the front wall 23A.

Into said trough 66 there opens the front part 20A of the supply duct 18 and the wall of which is aligned with said rear wall 24A. Both the take-off tube 34A and spinning tube 25A are oriented in the axis 22. The other elements of the spinning unit correspond to the respective ones shown in FIG. 1 and are provided with the same reference numerals.

In operation, a funnel-shaped air vortex is produced in the air chamber 21A (see arrows); the vortex is directed into the space between the spinning tube 25A and the mouth of the take-off tube 34A from which it is sucked, due to a sub-atmospheric pressure, into said spinning tube 25A.

A flow of discrete fibers is supplied through the supply duct 18 and is ejected through its front part 20A onto the outer wall of said funnel-shaped air vortex on which, as hereinabove set forth, fibers follow spherical trajectories and, finally, are densified and taken onto the yarn open end passing through the center of said vortex in the spinning tube 25A. The produced yarn P is withdrawn, twisted in the twist chamber 35 and wound on a bobbin (not shown).

This alternative embodiment of the air chamber 21A, when compared with the air chamber 21 shown in FIG. 1, is advantageous in that an abrupt change of air vortex course here occurs, said change being caused by sucking an air flow over the edge 65 of the spinning tube 25A. This air vortex course change has been found beneficial, on the one hand, to further straightening of the fibers taken in dense state onto the yarn end, and, on the other hand, to minimizing the fiber fly-off.

FIG. 4 also shows a variant of the core yarn manufacture; the core component 62 unwound from the supply package 63 through the thread guide 64 is fed through an opening 68 provided in the front part 20A of the supply duct 18, into the air chamber 21A and is led immediately into the flare end portion of the take-off tube 34A and wrapped therein with the yarn P being built in the spinning tube 25A. In its structure, the final core yarn product distinguishes, to some extent, from the core yarn produced in the spinning unit shown in FIG. 1.

Figure 5:
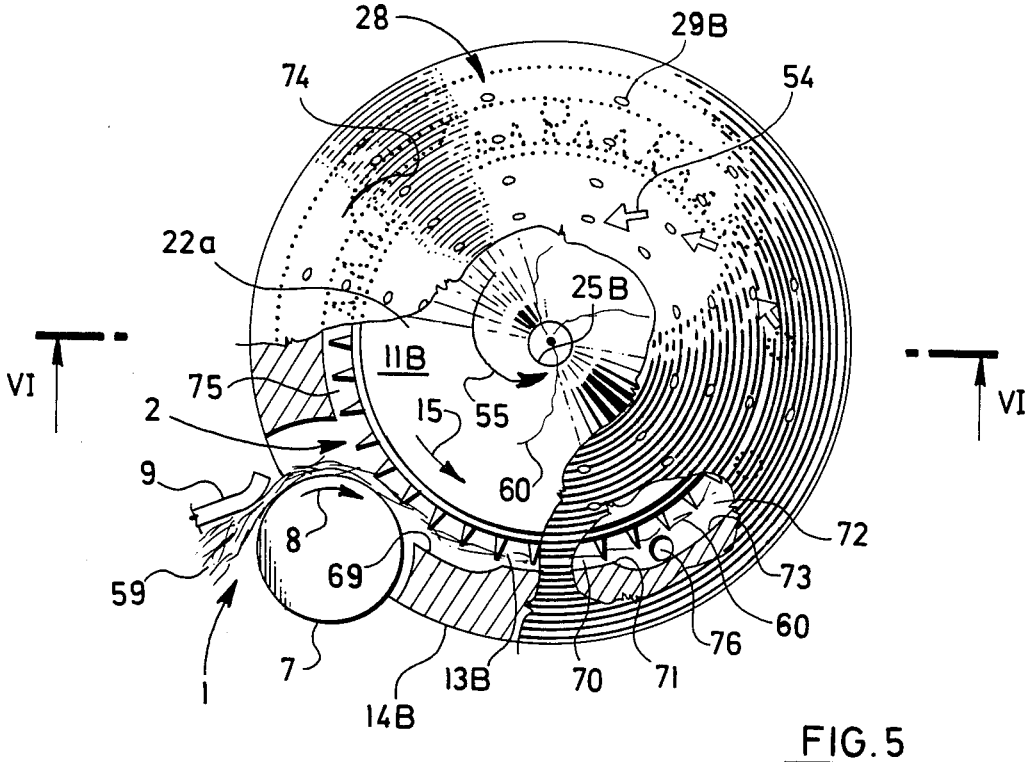
FIG. 5 is a partial cross-sectional view of the spinning unit with another variant of the air chamber.
Figure 6:
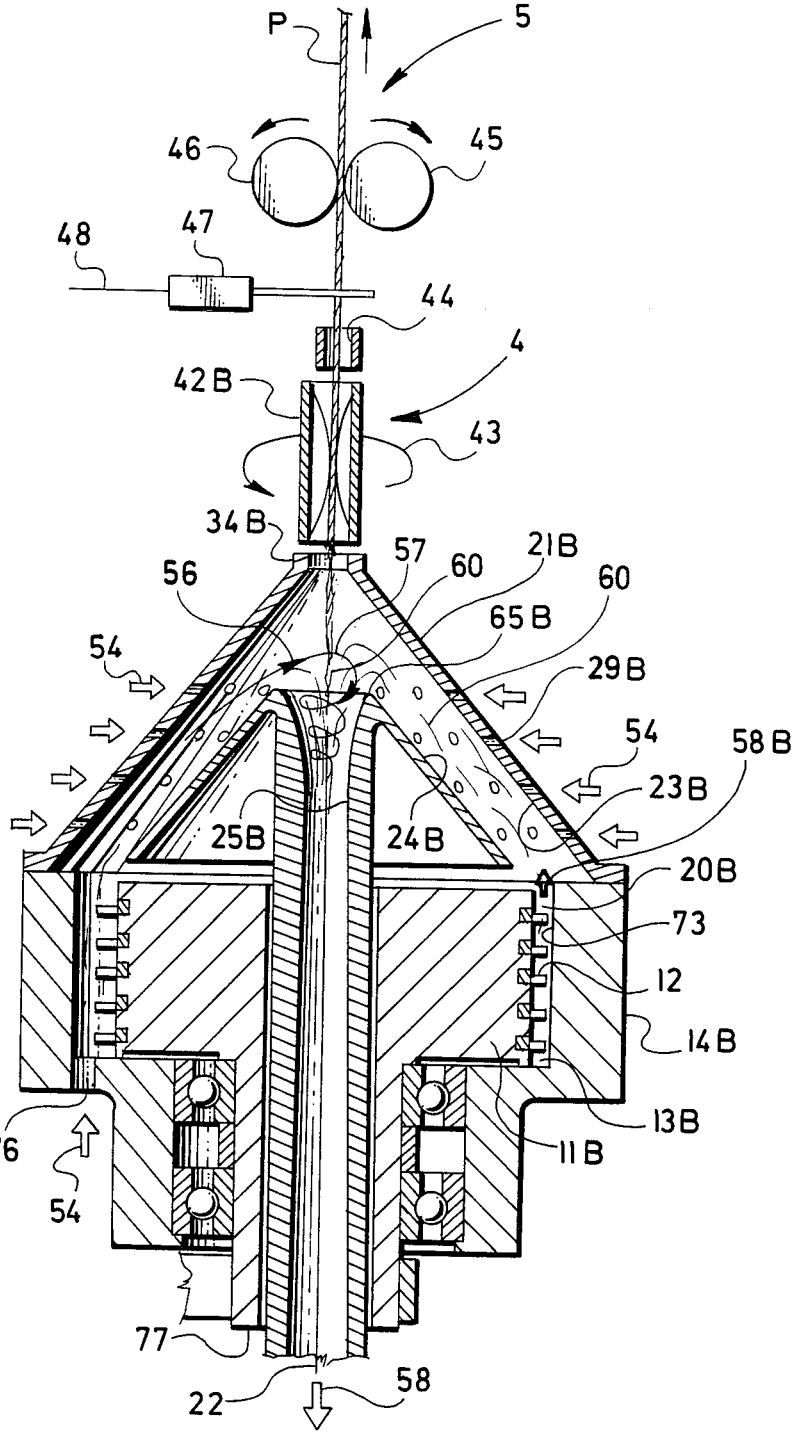
FIG. 6 is a sectional view taken along the line VI—VI in FIG. 5.

FIGS. 5 and 6 show another alternative embodiment of the spinning unit, where the air vortex is produced in the air chamber 21B by sucking in air from the ambient atmosphere, due to a sub-atmospheric pressure in the spinning tube 25B which communicates with a vacuum source.

The sliver feeding device 1 which comprises the feed roller 7 and the shoe 9 forced thereto by not shown spring means, and the fiber separating device 2 comprising the opening cylinder 11B, are accomodated in the recess 13B provided in the housing 14B. The side wall of said recess 13B defines, together with the surface of the opening cylinder 11B, a yarn transport way constituted in the direction of rotation (arrow 15) of the opening cylinder 11B, by a wedge-like space 69, a narrower annular space 72 defined by a spiral-forming wall 73 terminating at an edge 74 which latter merges again into a narrower annular space 75. The lower front wall of the recess 13B communicates with the ambient atmosphere through a system of holes 76.

In the wedge-like space 69, fibers are directed toward the surface of the opening cylinder 11B; the narrower annular space 70 accelerates the fiber motion; and the wider annular space 72 causes the fibers to be released from the surface of the opening cylinder 11B. Due to the air flow sucked in through the holes 76, the fibers are carried along into the air chamber 21B. The latter is defined by the funnel-shaped front wall 23B merging by its narrower end portion into a relatively short take-off tube 34B oriented in the axis 22, and by the conical rear wall 24B which extends in parallel to said front wall 23B and which merges over the edge 65B into spinning tube 25B also oriented in the axis 22. In the front wall 23B there are provided means 28 for producing an air vortex in the air chamber 21B, said means being embodied by air nozzles 29B in the form of holes through which the air chamber 21B communicates with the ambient atmosphere and which are oriented obliquely to the axis 22 and to the periphery of the front wall 23B. The front part 20B of the supply duct 18 which is defined by the spiral-forming wall 73 of the recess 13B of the housing 14B and by the surface of the opening cylinder 11B, opens into the space between the two walls 23B and 24B. On the spinning tube 25B which is integral with the rear wall 24B, the hub 77 of the opening cylinder 11B is mounted for rotation.

The take-off tube 34B simultaneously constitutes a tube of the additional twisting device 4 in the form of a false twist tube 42B which is rotatable in the direction of arrow 43 and which is mounted in a housing (not shown) between the take-off tube 34B and the guiding duct 44 (FIG. 6).

The feed roller 7, opening cylinder 11B, false twist tube 42B and take-off rollers 45, 46 which all constitute the yarn take-off device 5, are driven through not shown transmitting means from a not shown electric motor of the spinning unit. Between the take-off device 5 and the guiding duct 44 there is provided a tension detector 47 for monitoring the tension of yarn P. By means of not shown electrical means, the detector 47 controls an electromagnetic coupling (not shown) included into the drive of the feed roller 7, an electromagnetic coupling in the drive of the take-off rollers 45, 46 and an electromagnetic coupling in the drive of false twist tube 24B.

Due to a sub-atmospheric pressure prevailing in the air chamber 21B, air is sucked in through the air nozzles 29B and the holes 76. The sub-atmospheric pressure system in the entire spinning unit is shown by means of arrows 58. Air which enters the system through the air nozzles 29B, produces, in an interaction with the shape of the front wall 23B, an air vortex characterized by an intensive rotary motion about the axis 22 (FIG. 5, arrow 55), and by a translatory motion oblique to said axis 22 (see FIG. 6, arrow 56). The air vortex has the form of a funnel. Air escaping through the holes 76 provided in the bottom of the recess 13B, into the space between the side wall of said recess 13B and the surface of the opening cylinder 11B, produces an axial air flow (see arrow 58B) following the above-mentioned transport way about the spiral-forming wall 73 and further on into the air chamber 21B.

In the operation of the spinning unit, the opening cylinder combs individual fibers 60 in the wedge-like space 69 out of the supplied sliver 59. In a relatively narrow part of the annular space 70, the fibers are accelerated by the carding means 12 of the cylinder 11B so that a flow of discrete fibers is produced on said transport way downstream of the edge 71. Due to the action of air flow in the direction of arrow 58B (FIG. 6), the fibers are supplied into the air chamber 21B, and, due to the action of air flow in the direction of arrow 55, they are rotated and transported in the direction of the arrow 56 into the spinning tube 25B. In this way the fibers approach close to the axis 22 which simultaneously constitutes the axis of rotation of the open end of yarn P being formed in the spinning tube 25B.

From the fibers following the spherical trajectories of the air vortex in the air chamber 21B (see arrow 57) there is formed by doubling the elementary fibrous layer 60 which, after entering the spinning tube 25B, is densified and adheres to the open end of yarn P. The spinning process and the process of controlling the spinning unit take place in manner analogous to that hereinabove set forth.

Figure 7:
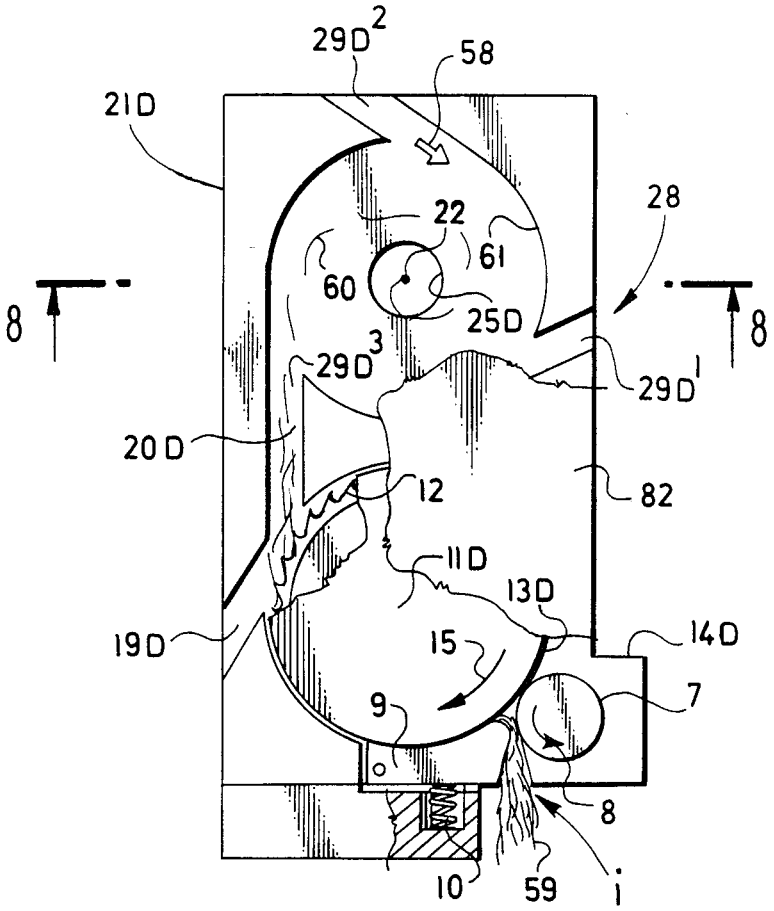
FIG. 7 is a partial front view of a variant of the air chamber.
Figure 8:
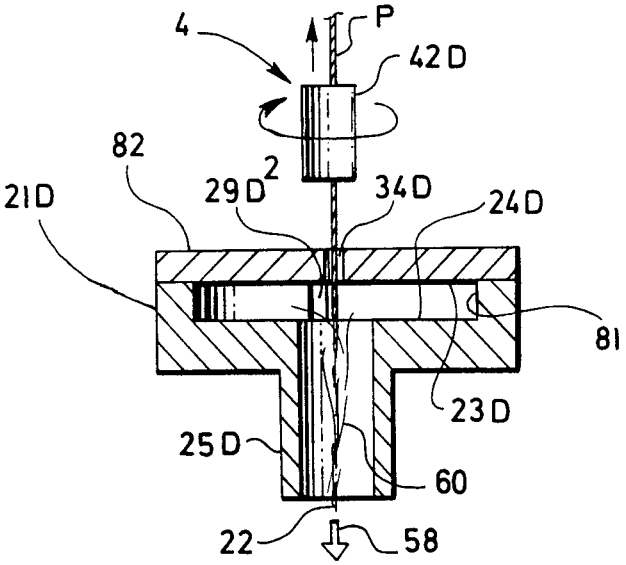
FIG. 8 is a sectional view taken along the line 8—8 in FIG. 7.

FIGS. 7 and 8 schematically show another exemplary embodiment of the spinning unit comprising the air chamber 21D defined by the front wall 23D with the take-off tube 34D, by the rear wall 24D which is plane-parallel with said front wall 23D and merges into the spinning tube 25D communicating with a not shown sub-atmospheric pressure source, and by a side wall 81 perpendicular to the two said walls 23D and 24D. Both the take-off tube 34D and the spinning tube 25D are oriented in the axis 22 of the air chamber 21D. The side wall 81, the rear wall 24D and the spinning tube 25D form, preferably, an integral part.

Means 28 for producing a funnel-shaped air vortex in the air chamber 21D, which vortex converges to the axis 22 of the latter, are embodied as air nozzles 29D$^1$, 29D$^2$, and 29D$^3$ in the form of ducts oriented so as to enter the air chamber 21D obliquely with respect to the rear wall 24D and through the side wall 81 tangentially thereof, said ducts communicating with the ambient atmosphere. The air nozzle 29d$^3$ simultaneously assumes the function of the fiber supply duct 18 having the rear part 19D which latter, in the region of the opening cylinder 11D, merges, at an angle, into the front part 20D entering the air chamber 21D tangentially thereof.

The active elements of the spinning unit are accomodated in the housing 14D comprising the recess 13D for the opening cylinder 11D, the air nozzles 29D$^1$, 29S$^2$ and 29D$^3$, and the recess for the sliver feeding device 1 which substantially corresponds to the feeding device shown in FIG. 1. The front wall 23D of the air chamber 21D is constituted by the inner wall of a lid 82 covering the housing 14D (FIG. 8). The take-off tube 34D is followed by the false twist tube 42D which assumes the function of an additional twisting device.

By starting the feeding device 1 and the separating device 2, and by communicating the spinning tube 25D with a sub-atmospheric pressure source there is produced in the air chamber 21D a funnel-shaped air vortex which, on its trajectory converging to the axis 22 of the air chamber 21D, simultaneously carries the discrete fibers 60 supplied into the air chamber 21D through the air nozzle 29D$^3$. The method of producing yarn P has been explained in the description of the previous embodiments.

In the above-described exemplary embodiments of the invention, only some typical shapes of air chamber have been specified. The essential feature thereof as well as of any other air chambers within the scope of the present invention consists in that in the front wall 23, 23A, 23B, and 23D there is provided the yarn take-off tube 34, 34A, 34B, and 34D, and that the rear wall 24, 24A, 24B, and 24D tapers into the spinning tube 25, 25A, 25B, and 25D, respectively.

It is preferably that the front wall 23 of the air chamber 21 be planar (FIGS. 1, 3, 13), or funnel-shaped with a conical wall (FIG. 6), or with a convex conical wall (not shown).

Further, it is preferable that the rear wall 24 in combination with the front wall 23 of the air chamber 21 be with the planar front wall 23, conically convex (FIG. 1), or planar (FIG. 8);

with the conically convex front wall, conical (FIG. 4), or planar (not shown);

with the conical front wall, conical (FIG. 6), or conically concave (not shown).

It is an object of the air chamber to produce, in an interaction with the air nozzles, a suitably shaped funnel-shaped air vortex which is oriented toward the axis of the air chamber and which constitutes a fiber carrier.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In a method of spinning yarn from staple fibers in an air vortex in a stationary spinning tube axially coupled to a stationary air chamber, by taking supplied individualized fibers onto an open yarn end engaging into the spinning tube which communicates with a sub-atmospheric pressure source, and from which the arising yarn is withdrawn by a take-off device in counter direction to the axial motion of an air vortex produced in the air chamber and directed toward its axis, the improvement wherein in the air chamber there is produced a funnel-shaped air vortex which is sucked off by the spinning tube and has an internal and an external air wall, and wherein individualized fibers are supplied in the air chamber onto one of said air walls of the air vortex which entrains, doubles and takes the fibers in the spinning tube onto the open end of yarn additionally twisted during the take-off in the region between the air chamber and the take-off device.

2. In an apparatus for spinning yarn from staple fibers in an air vortex comprising a stationary air chamber, means for producing in said chamber an air vortex converging to the chamber axis, a yarn take-off duct axially engaging into the air chamber, a stationary spinning tube communicating by one of its ends with a sub-atmospheric pressure source, and by its other end with said air chamber, a supply duct for introducing individualized fibers, and a take-off device for withdrawing the yarn through said take-off duct from the spinning tube, the improvement wherein means are provided for producing a funnel-shaped air vortex having an internal and an external air wall and sucked off by the spinning tube, the supply duct which opens into the air chamber, being directed so as to supply the individualized fibers in the air chamber onto one of said air walls, and wherein an additional twisting device is provided between the take-off device and the air chamber.

3. An apparatus as claimed in claim 2, wherein the air chamber is defined by a front wall which is perpendicular to the axis of the air chamber and which comprises a yarn take-off tube oriented in the axis of the air chamber, and by a funnel-shaped rear wall which tapers toward the spinning tube oriented in the axis of the air chamber into which the front part of the supply duct extends obliquely to said axis.

4. An apparatus as claimed in claim 2, wherein the air chamber is defined by the funnel-shaped front wall which comprises the take-off tube oriented in the axis of the air chamber, and by a conical rear wall the narrower portion of which merges over an edge into the spinning tube oriented in the axis of the air chamber while its wider portion merges into said front wall over a trough, said trough being passed through by the front part of the supply duct.

5. An apparatus as claimed in claim 4, wherein the rear wall of the air chamber there is provided at least one air nozzle formed by a radial guide gap in an inner annular cavity provided in the rear wall of the air chamber and communicating through holes oriented obliquely to the axis of the air chamber with an outer annular cavity to which a pressurized pipeline is tangentially coupled.

6. An apparatus as claimed in claim 2, comprising a fiber separating device having a housing and wherein the air chamber is defined, on the one hand, by the funnel-shaped front wall comprising a take-off tube oriented in the axis of the air chamber, there being provided in said front wall air nozzles in the form of holes communicating with ambient atmosphere and oriented obliquely to the axis of the air chamber and to the periphery of said wall, and, on the other hand, by the conical rear wall which is parallel to said front wall and merges over the edge into the spinning tube oriented in the axis of the air chamber, there extending into the space between said two walls a supply duct which is defined by a spiral-shaped wall of a recess in the housing of the fiber separating device, and by the surface of a fiber opening cylinder mounted in the housing of the fiber separating device, said cylinder being mounted for rotation about the spinning tube.

7. In an apparatus for spinning yarn from staple fibers in an air vortex comprising a stationary air chamber, means for producing in said chamber an air vortex converging to the chamber axis, a yarn take-off duct axially engaging into the air chamber, a stationary spinning tube communicating by one of its ends with a subatmospheric pressure source, and by its other end with said air chamber, a supply duct for introducing individualized fibers, and a take-off device for withdrawing the yarn through said take-off duct from the spinning tube the improvement wherein means are provided for producing a funnel-shaped air vortex having and internal and an external air wall and sucked off by the spinning tube, the supply duct which opens into the air chamber, being directed so as to supply the individualized fibers in the air chamber into the air vortex, and wherein an additional twisting device is provided between take-off device and the air chamber.

8. An apparatus as claimed in claim 7, wherein the air chamber is defined by the planar front wall which is perpendicular to the axis of said air chamber, and by the planar rear wall which is parallel to said front wall, there being arranged between said walls a side wall in which air nozzles are provided, said nozzles having the form of ducts extending obliquely to said rear wall and tangentially to said side wall.

9. In a method of spinning yarn from staple fibers in an air vortex in a stationary spinning tube axially coupled to a stationary air chamber, by taking supplied individualized fibers onto an open yarn end engaging into the spinning tube which communicates with a subatmospheric pressure source, and from which the arising yarn is withdrawn by a take-off device in counter direction to the axial motion of an air vortex produced in the air chamber and directed toward its axis, the improvement wherein in the air chamber there is produced a funnel-shaped air vortex which is sucked off by the spinning tube and has an internal and an external air wall, and wherein individualized fibers are supplied to the air chamber into the air vortex which entrains, doubles and takes the fibers in the spinning tube onto the open end of yarn additionally twisted during the take-off in the region between the air chamber and the take-off device.

* * * * *